US011596856B2

(12) United States Patent
Shigeta

(10) Patent No.: US 11,596,856 B2
(45) **Date of Patent: *Mar. 7, 2023**

(54) CARD SHOW APPARATUS AND TABLE GAME SYSTEM

(71) Applicant: ANGEL GROUP CO., LTD.

(72) Inventor: Yasushi Shigeta, Shiga (JP)

(73) Assignee: ANGEL GROUP CO., LTD., Shiga (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/230,258

(22) Filed: Apr. 14, 2021

(65) Prior Publication Data

US 2021/0228975 A1 Jul. 29, 2021

Related U.S. Application Data

(63) Continuation of application No. 16/409,319, filed on May 10, 2019, now Pat. No. 11,007,422, which is a (Continued)

(30) Foreign Application Priority Data

Sep. 25, 2012 (JP) ..... 2012-227444
Sep. 28, 2012 (JP) ..... PCT/JP2012/006230

(51) Int. Cl.
*A63F 1/14* (2006.01)
*A63F 1/12* (2006.01)
(Continued)

(52) U.S. Cl.
CPC ..... *A63F 1/14* (2013.01); *A63F 1/12* (2013.01); *A63F 1/18* (2013.01);
(Continued)

(58) Field of Classification Search
USPC ..... 463/12, 11, 13
See application file for complete search history.

(56) References Cited

U.S. PATENT DOCUMENTS 4,513,696 A 4/1985 Fujii et al.
4,513,969 A 4/1985 Samsei, Jr.
(Continued)

FOREIGN PATENT DOCUMENTS

AU 2013203307 B2 4/2014
AU 2015202960 A1 6/2015
(Continued)

OTHER PUBLICATIONS

Chinese Office Action dated Feb. 15, 2019 for CN application 201610830365.6.
(Continued)

*Primary Examiner* — Pierre E Elisca
(74) *Attorney, Agent, or Firm* — Norton Rose Fulbright US LLP

(57) ABSTRACT

A system includes a card shoe that includes a housing for housing cards and an opening through which the housed cards can be drawn. The system includes a computer to detect whether there is any of the following predefined arrangements: (1) for each of a predefined number of consecutively drawn cards, the respective rank of the respective card is larger or smaller by one than an immediately preceding one of the cards drawn from the card housing; (2) a respective rank of each of a predefined number of consecutively drawn cards is the same; (3) a respective suit of each of a predefined number of consecutively drawn cards is the same; or (4) a same sequence in which a predefined number of the cards are consecutively drawn is repeated.

20 Claims, 9 Drawing Sheets

Related U.S. Application Data continuation of application No. 15/456,322, filed on Mar. 10, 2017, now Pat. No. 10,335,670, which is a continuation of application No. 14/431,239, filed as application No. PCT/JP2013/004956 on Aug. 22, 2013, now Pat. No. 10,124,242.

(51) Int. Cl.
*A63F 1/18* (2006.01)
*A63F 9/24* (2006.01)

(52) U.S. Cl.
CPC ..... *A63F 2009/2419* (2013.01); *A63F 2009/2451* (2013.01); *A63F 2009/2457* (2013.01); *A63F 2250/58* (2013.01)

(56) References Cited

U.S. PATENT DOCUMENTS 4,534,562 A 8/1985 Cuff et al.
4,586,712 A 5/1986 Lorber et al.
4,794,239 A 12/1988 Allais
5,067,713 A 11/1991 Soules et al.
5,166,502 A 11/1992 Rendleman et al.
5,169,155 A 12/1992 Soules et al.
5,259,907 A 11/1993 Soules et al.
5,331,141 A 7/1994 Kaneko
5,374,061 A 12/1994 Albrecht
5,669,813 A 9/1997 Jairazbhoy
5,669,816 A 9/1997 Garczynski et al.
5,707,287 A 1/1998 McCrea, Jr.
5,722,893 A 3/1998 Hill et al.
5,779,546 A 7/1998 Meissner
5,814,804 A 9/1998 Kostizak
5,911,626 A 6/1999 McCrea, Jr.
5,941,769 A 8/1999 Order
5,989,122 A 11/1999 Roblejo
6,039,650 A 3/2000 Hill
6,042,150 A 3/2000 Daley
6,066,857 A 5/2000 Fanton et al.
6,093,103 A 7/2000 McCrea, Jr.
6,098,892 A 8/2000 Peoples, Jr.
6,126,166 A 10/2000 Lorson et al.
6,217,447 B1 4/2001 Lofink et al.
6,270,406 B1 8/2001 Sultan
6,460,848 B1 10/2002 Soltys et al.
6,527,191 B1 3/2003 Jannersten
6,582,301 B2 6/2003 Hill
6,588,751 B1 7/2003 Grauzer et al.
6,629,894 B1 10/2003 Purton
6,637,622 B1 10/2003 Robsinson
6,638,161 B2 10/2003 Soltys et al.
7,029,009 B2 4/2006 Grauzer et al.
7,093,130 B1 8/2006 Kobayashi et al.
7,172,507 B2 2/2007 Fujimoto et al.
7,222,852 B2 5/2007 Soltys et al.
7,422,522 B2 9/2008 Fujimoto et al.
7,762,889 B2 7/2010 Shigeta
7,946,586 B2 5/2011 Krenn et al.
7,950,663 B2 5/2011 Schubert et al.
7,967,672 B2 6/2011 Shigeta
8,221,244 B2 7/2012 French
8,309,163 B2 11/2012 Van Duren et al.
8,490,973 B2 7/2013 Yoseloff et al.
8,556,262 B2 10/2013 Shigeta
8,590,896 B2 11/2013 Krenn et al.
8,801,516 B2 8/2014 Shigeta
9,649,550 B2 5/2017 Shigeta
2002/0017481 A1 2/2002 Johnson et al.
2002/0063389 A1 5/2002 Breeding et al.
2002/0068635 A1 6/2002 Hill
2002/0155869 A1 10/2002 Soltys et al.
2002/0163125 A1 11/2002 Grauzer et al.
2002/0165029 A1 11/2002 Soltys et al.
2003/0003997 A1 1/2003 Vuong et al.
2003/0171142 A1 9/2003 Kaji et al.
2003/0176209 A1 9/2003 Soltys et al.
2003/0195025 A1 10/2003 Hill
2004/0026638 A1 2/2004 Shigeta
2004/0100026 A1 5/2004 Haggard
2004/0259618 A1* 12/2004 Soltys ..... A63F 1/02 463/11
2005/0012270 A1 1/2005 Schubert et al.
2005/0051955 A1 3/2005 Schubert et al.
2005/0062226 A1 3/2005 Schubert et al.
2005/0062227 A1 3/2005 Grauzer et al.
2005/0104290 A1 5/2005 Grauzer et al.
2005/0110210 A1 5/2005 Soltys et al.
2005/0121852 A1 6/2005 Soltys et al.
2005/0137005 A1 6/2005 Soltys et al.
2006/0063577 A1* 3/2006 Downs, III ..... A63F 1/18 463/11
2006/0247036 A1 11/2006 Shigeta
2006/0279040 A1* 12/2006 Downs, III ..... A63F 1/14 273/149 R
2007/0018389 A1 1/2007 Downs, III
2007/0216092 A1 9/2007 Fleckenstein
2007/0296151 A1* 12/2007 Kyrychenko ..... G07F 17/3288 273/309
2008/0006997 A1 1/2008 Scheper et al.
2008/0105750 A1 5/2008 Shigeta
2008/0143048 A1 6/2008 Shigeta
2008/0224394 A1 9/2008 Shigeta
2009/0066021 A1 3/2009 Shigeta
2009/0134575 A1 5/2009 Dickenson et al.
2009/0140492 A1* 6/2009 Yoseloff ..... G07F 17/3293 463/25
2009/0224476 A1* 9/2009 Grauzer ..... A63F 1/14 463/47
2010/0133754 A1 6/2010 Shigeta
2010/0213667 A1 8/2010 Grauzer et al.
2010/0276887 A1 11/2010 Yoshida
2010/0289214 A1 11/2010 Just
2010/0327525 A1 12/2010 Shigeta
2011/0034243 A1 2/2011 Shigeta
2011/0130185 A1 6/2011 Waiker
2011/0148038 A1 6/2011 Laughlin
2011/0198805 A1 8/2011 Downs, III et al.
2011/0210175 A1 9/2011 Shigeta
2011/0275432 A1 11/2011 Lutnick et al.
2012/0081656 A1 4/2012 Blaha et al.
2012/0306152 A1 12/2012 Krishnamurty et al.
2013/0207344 A1 8/2013 Shigeta
2013/0303277 A1 11/2013 Shigeta
2014/0042697 A1 2/2014 Berube et al.
2015/0014925 A1 1/2015 Miller et al.
2015/0190707 A1 7/2015 Shigeta
2015/0238849 A1* 8/2015 Shigeta ..... A63F 1/12 463/12
2015/0375095 A1 12/2015 Shigeta

FOREIGN PATENT DOCUMENTS

CN 1525874 A 9/2004
CN 2772570 Y 4/2006
CN 1933881 A 3/2007
CN 101099896 A 1/2008
CN 101437586 A 5/2009
CN 101484216 A 7/2009
CN 101541388 A 9/2009
CN 101584934 A 11/2009
CN 101588847 A 11/2009
CN 101678232 A 3/2010
CN 101711177 A 5/2010
CN 101732850 A 6/2010
CN 101804251 A 8/2010
CN 201537379 U 8/2010
CN 101884840 A 11/2010
CN 101920104 A 12/2010
CN 101959563 A 1/2011
CN 101972544 A 2/2011
CN 102307633 A 1/2012
CN 202398088 U 8/2012

(56) References Cited

FOREIGN PATENT DOCUMENTS

| | | | |
|---|---|---|---|
| GB | 2380143 | A1 | 4/2003 |
| JP | H05-000398 | | 1/1993 |
| JP | H05-020512 | | 1/1993 |
| JP | H09-215812 | | 3/1997 |
| JP | H09-144353 | | 6/1997 |
| JP | H10-508236 | A | 8/1998 |
| JP | 2000-327255 | | 11/2000 |
| JP | 2001-222687 | | 8/2001 |
| JP | 2002-165916 | | 6/2002 |
| JP | 2002-224443 | | 8/2002 |
| JP | 2002-282413 | | 10/2002 |
| JP | 2003-052902 | | 2/2003 |
| JP | 2003-070956 | | 3/2003 |
| JP | 2003-144742 | | 5/2003 |
| JP | 2003-250950 | | 9/2003 |
| JP | 2004-215806 | A | 8/2004 |
| JP | 2005-198668 | | 7/2005 |
| JP | 2005-267625 | | 9/2005 |
| JP | 2005-296634 | A | 10/2005 |
| JP | 2007-236995 | | 9/2007 |
| JP | 2008-161479 | A | 7/2008 |
| JP | 2008-188471 | | 8/2008 |
| JP | 2009-213520 | A | 9/2009 |
| JP | 2012061023 | A | 3/2012 |
| JP | 4964037 | B2 | 6/2012 |
| WO | 1996/14115 | | 5/1996 |
| WO | 1999/043404 | A1 | 9/1999 |
| WO | 2001/056670 | | 8/2001 |
| WO | 0205914 | A1 | 1/2002 |
| WO | 2002/064225 | | 8/2002 |
| WO | 2002/094397 | A1 | 11/2002 |
| WO | 2003/026763 | | 4/2003 |
| WO | 2003/078006 | A2 | 9/2003 |
| WO | 2003/078006 | A3 | 9/2003 |
| WO | 2009/069708 | A1 | 8/2009 |
| WO | 2009/126780 | A2 | 10/2009 |
| WO | 2010/019708 | A1 | 2/2010 |
| WO | 2010/055328 | A1 | 5/2010 |
| WO | 2010056562 | A1 | 5/2010 |
| WO | 2012035742 | A1 | 3/2012 |
| WO | 2012/053179 | A1 | 4/2012 |
| WO | 2012/166197 | A1 | 12/2012 |
| WO | 2013/116297 | A1 | 8/2013 |
| WO | 2014/049664 | | 4/2014 |
| WO | 2010052573 | A2 | 5/2014 |

OTHER PUBLICATIONS

Chinese Office Action, Chinese Patent Application No. 201380049993.5, dated Jan. 4, 2017.
Chinese Office Action, Chinese Patent Application No. 201280075345.2, dated Jan. 3, 2017.
Australian Patent Examination Report No. 1, Australian Patent Application No. 2013203307, dated Oct. 15, 2014.
Australian Patent Examination Report No. 1, Australian Patent Application No. 2013203316, dated Dec. 10, 2014.
International Search Report, International Application No. PCT/JP2013/004956, dated Sep. 24, 2013.
Australian Examiner's First Report, Australian Patent Application No. 2008200596, dated Nov. 6, 2009.
Australian Examiner's Report No. 2, Australian Patent Application No. 2010235931, dated Jul. 11, 2011.
International Preliminary Report on Patentability, International Application No. PCT/JP2005/003789, dated Feb. 2, 2006.
Intenational Search Report, International Application No. PCT/JP2005/003789, dated Apr. 26, 2005.
International Search Report, International Application No. PCT/JP2012/006230, dated Nov. 13, 2012.
Final Office Action, U.S. Appl. No. 10/542,073, dated Apr. 14, 2010.
Non-Final Office Action, U.S. Appl. No. 11/884,021, dated Dec. 8, 2010.
Non-Final Office Action, U.S. Appl. No. 11/929,727, dated Oct. 1, 2010.
Non-Final Office Action, U.S. Appl. No. 11/929,727, dated Mar. 7, 2011.
Non-Final Office Action, U.S. Appl. No. 12/231,657, dated Mar. 19, 2010.
Final Office Action, U.S. Appl. No. 12/231,657, dated Dec. 8, 2010.
Non-Final Office Action, U.S. Appl. No. 12/825,261, dated Nov. 23, 2010.
New Zealand First Examination Report, NZ Patent Application No. 704620, dated Jul. 31, 2015.
Chinese First Office Action, Chinese Patent Application No. 201310225940.6, dated Dec. 3, 2015.
New Zealand First Examination Report, NZ Patent Application No. 706311 dated Dec. 8, 2015.
Korean Office Action, Korean Patent Application No. 10-2015-7007553, dated Mar. 28, 2016.
New Zealand First Examination Report, NZ Patent Application No. 716059, dated May 6, 2016.
Australian Examination Report No. 1, Australian Patent Application No. 2015202960, dated Jun. 9, 2016.
Korean Notice of Allowance, Korean Patent Application No. 10-2015-7007316, dated Jun. 16, 2016.
Chinese Notice of Allowance, Chinese Patent Application No. 201310220992.4, dated Jul. 4, 2016.
New Zealand First Examination Report, NZ Patent Application No. 720973, dated Jul. 29, 2016.
International Search Report, European Patent Application No. 13842336.3, dated Aug. 24, 2016.
Australian Examination Report No. 2 dated Jun. 17, 2018 for AU application 2016262639.
Australian Examination Report No. 1 dated Aug. 3, 2018 for AU application 2017225160.
U.S. Notice of Allowance dated Jun. 8, 2018 for U.S. Appl. No. 14/431,239.
U.S. Office Action dated Aug. 9, 2018 for U.S. Appl. No. 14/419,605.
Chinese Aiiawance dated Mar. 19, 2018 for corresponding Chinese application 201510315068.3.
Australian Office Action, Australian Patent Application No. 2016208351, dated May 11, 2017.
Australian Office Action, Australian Patent Application No. 2016208352, dated May 11, 2017.
Office Action dated Aug. 29, 2017 for JP Application 2016-240958 (Japanese language).
Office Action dated Sep. 6, 2017 for U.S. Appl. No. 14/431,239.
Australian Examination Report dated Jan. 19, 2018 for corresponding Australian application 2016262639.
New Zealand First Examination Report dated Dec. 4, 2017 for corresponding New Zealand application 731453.
Filipino Substantive Examination Report dated May 2, 2019 for corresponding Philippine application No. 1-2015-502779.
Chinese Office Action, CN Patent Application No. 201610827326.0, dated Mar. 1, 2019.
Japanese Office Action dated Oct. 8, 2019 for corresponding JP Application 2018-210439.
Chinese Office Action dated Dec. 25, 2019 for corresponding CN Application 201710188722.8.
Japanese Office Action dated May 11, 2020 for corresponding JP Application 2018-210439.
Filipino Office Action dated Jul. 13, 2020 for corresponding PH Application 1-2019-502270.

* cited by examiner

| Combination | Positional Relationship of Marks | Sensor Output |
|---|---|---|
| 1 | Blank<br>Blank | OFF<br>OFF |
| 2 | Blank<br>M | OFF<br>ON OFF |
| 3 | M<br>Blank | ON OFF<br>OFF |
| 4 | M<br>M | ON OFF<br>ON OFF |

FIG. 7

CARD SHOW APPARATUS AND TABLE GAME SYSTEM

CROSS REFERENCE TO RELATED APPLICATIONS

The present application is a continuation of U.S. patent application Ser. No. 16/409,319 filed May 10, 2019, which is a continuation of U.S. patent application Ser. No. 15/456,322 filed Mar. 10, 2017 (now U.S. Pat. No. 10,335,670), which is a continuation of U.S. patent application Ser. No. 14/431,239 filed Mar. 25, 2015 (now U.S. Pat. No. 10,124,242), which is a 35 USC 371 national-phase application of International Application PCT/JP2013/004956 filed Aug. 22, 2013, which claims priority to International Application PCT/JP2012/006230 filed Sep. 28, 2012 and JP Application 2012-227444 filed Sep. 25, 2012; each of the listed applications is incorporated herein by reference.

TECHNICAL FIELD

The present invention relates to a card shoe apparatus and a table game system with a function of preventing cheating in a card game played with playing cards (hereinafter simply referred to as "cards") such as baccarat.

BACKGROUND ART

In poker, baccarat, bridge, blackjack, and other card games, a dealer sets one or more decks of playing cards in a card shoe or the like, and deals cards to game players by drawing out the cards one by one out of the card shoe or the like. In doing so, to ensure fairness in the games, the cards need to be dealt at random. Therefore, a game host has to sufficiently shuffle the playing cards randomly in order to ensure a random order of arrangement of the playing cards before they are set in the card shoe.

A conventional card shuffling device for shuffling cards is disclosed in, for example, Patent Literature 1.

The shuffled playing cards used in various card games such as poker, baccarat, bridge or blackjack include, ordinarily, 416 cards if eight decks of cards are used, and we cannot completely eliminate the possibility of the occurrence of a state in which such shuffled playing cards are arranged not in a random order but in a specific order instead (for example, a state of ten consecutive Ace cards) for some reason. If a set of cards that has not been sufficiently shuffled to be arranged in a random order is set in a card shoe or the like and used in a game, the fairness of the game may not be secured, which is a problem. In a card game, the arrangement order of the cards that are drawn during the game is important; the cards are drawn in such an order and the winner/loser of the game is also decided by the arrangement order.

Citation List Patent Literature 1: WO 2009/069708

The present invention has been made in view of the above problems, and aims to provide a card shoe and a table game system capable of detecting a state in which the shuffled playing cards to be used in a card game are not randomly arranged when the card shoe deals the cards onto the game table, thereby preventing the condition of an unfair game, and the dealing of cards of a card set arranged in a specific order, which thus, should not be dealt onto the game table, as well as a method therefor.

SUMMARY OF THE INVENTION

One aspect of the present invention is a card shoe apparatus, and a card shoe apparatus for storing shuffled playing cards on a game table and manually dealing the cards housed in the card shoe apparatus one by one onto the game table, the card shoe apparatus comprising: a card housing unit for housing the shuffled playing cards; an opening unit for drawing out the cards from the card housing unit one by one; a card reading unit that reads, from a card, information provided in the card drawn from the card housing unit onto the game table; a control unit that stores rules of a card game, and determines the winner/loser of the card game according to said rules, based on the information of the cards read by the card reading unit; and an output unit that outputs a result of the winner/loser determined by the control unit, wherein the control unit has a shuffling checking function of storing the information of the cards read by the card reading unit for a predetermined number of cards, detecting and outputting an irregularity of the shuffled playing cards housed in the card housing unit based on the information of the cards read by the card reading unit, and outputting an irregularity alarm, the irregularity of the shuffled playing cards being at least one of the following cases: (1) a case where a state in which the rank of a card is larger or smaller by one than the card preceding that card continues for a predetermined number of cards; (2) a case where cards with the same rank continue for a predetermined number of cards; (3) a case where the same sequence is repeated throughout a predetermined number of cards; (4) a case where cards with the same suit continue for at least a predetermined number of cards; (5) a case where the arrangement order of a predetermined number of cards matches an arrangement order registered in advance; (6) a case where a state in which a card drawn has the same suit and rank as the card that precedes the card drawn by 52 cards continues for a plurality of cards; and (7) a case that corresponds to a case that has been registered in advance as an irregular case. (8) a case where cards with the same rank and suit are drawn for at least a predetermined number of cards.

As explained hereinafter, there are other aspects in the present invention. Accordingly, this disclosure of the invention is intended to provide some aspects of the present invention, and is not intended to limit the scope of the invention described and claimed herein.

BRIEF DESCRIPTION OF DRAWINGS

FIG. 7 is a diagram showing the relation between output waves from sensors and marks in the card shoe apparatus.

DETAILED DESCRIPTION

Figure 1:
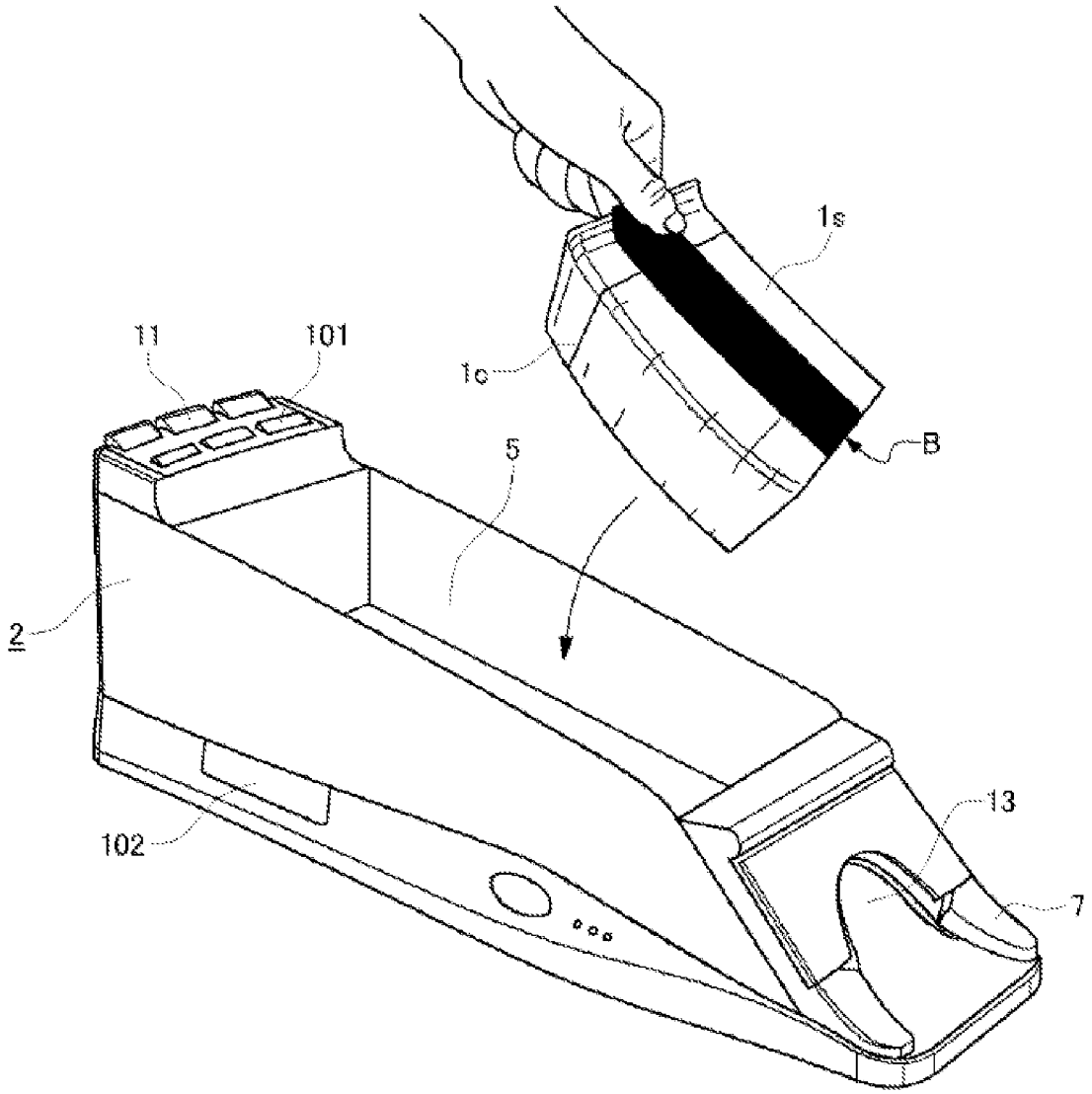
FIG. 1 is a perspective view schematically showing the entirety of a table game system according to an embodiment of the present invention.

Detailed explanation of the present invention will be mentioned hereinafter. However, the following detailed explanation and accompanying drawings do not limit the invention.

To solve the above conventional problems, the present invention provides a table game system including: shuffled playing cards made up of a predetermined number of cards, the cards having been shuffled in advance, each card with information representing a rank thereof as a code that is normally invisible; and, a card shoe apparatus for storing the shuffled playing cards on a game table and manually dealing the cards housed in the card shoe apparatus one by one onto the game table, wherein the card shoe apparatus includes: a card housing unit for housing the shuffled playing cards; an opening unit for drawing out the cards from the card housing unit one by one a card reading unit that reads the code provided in the card drawn from the card housing unit onto the game table, a control unit that stores rules of a card game, and determines the winner/loser of the card game according to said rules, based on the information of the cards read by the card reading unit; and a output unit that outputs a result of the winner/loser determined by the control unit, and the control unit has a shuffling checking function of storing the information of the cards read by the card reading unit for a predetermined number of cards, detecting and outputting an irregularity of the shuffled playing cards housed in the card housing unit based on the information of the cards read by the card reading unit, the irregularity of the shuffled playing cards being at least one of the following cases:

(1) a case where a state in which the rank of a card is larger (or smaller) by one than the card preceding that card continues for a predetermined number of cards (for example, 1, 2, 3, 4, - - - , K);
(2) a case where cards with the same rank continue for a predetermined number of cards (for example, A, A, A, A, - - - );
(3) a case where the same sequence is repeated throughout a predetermined number of cards (for example, A, Q, 10, A, Q, 10, - - - );
(4) a case where cards with the same suit continue for at least a predetermined number of cards (for example, 13 consecutive cards with Hearts);
(5) a case where the arrangement order of a predetermined number of cards matches an arrangement order registered in advance;
(6) a case where a state in which a card drawn has the same suit and rank as the card that precedes the card drawn by 52 cards continues for a plurality of cards;
(7) a case that corresponds to a case that has been registered in advance as an irregular case; and
(8) a case where cards with the same rank and suit are drawn for at least a predetermined number of cards.

With the present invention, it is possible to provide a table game system capable of detecting a state in which the shuffled playing cards to be used in a card game are not randomly arranged when a card shoe deals the cards onto a game table, thereby preventing the condition of an unfair game, and the dealing of a predetermined number or more of cards of a card set arranged in a specific order, which thus, should not be dealt.

Figure 2:
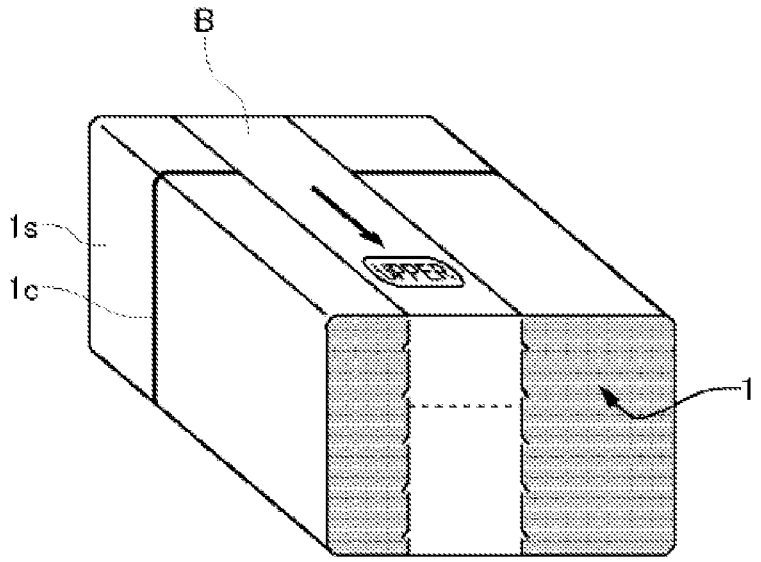
FIG. 2 is a perspective view of shuffled playing cards to be used in the table game system according to the embodiment.

An embodiment of a table game system of the present invention will be described below. FIG. 1 is a perspective view schematically showing the entirety of a table game system according to the present embodiment. FIG. 2 is a perspective view of shuffled playing cards to be used in the table game system of the present embodiment. A shuffled playing card set is used in the table game system of the present embodiment is provided in a state in which cards 1 made up of a predetermined number of decks (normally, 6, 8 or 10 decks) have been shuffled and randomly arranged. On the game table, the shuffled playing card set 1*s* is housed in a card shoe apparatus 2 bundled with a band (B), and thereafter, the band (B) is undone and removed such that the cards 1 of the shuffled playing cards 1*s* can be dealt one by one. During a game, a dealer deals the cards 1 onto the game table out of the card shoe apparatus 2.

Figure 3:
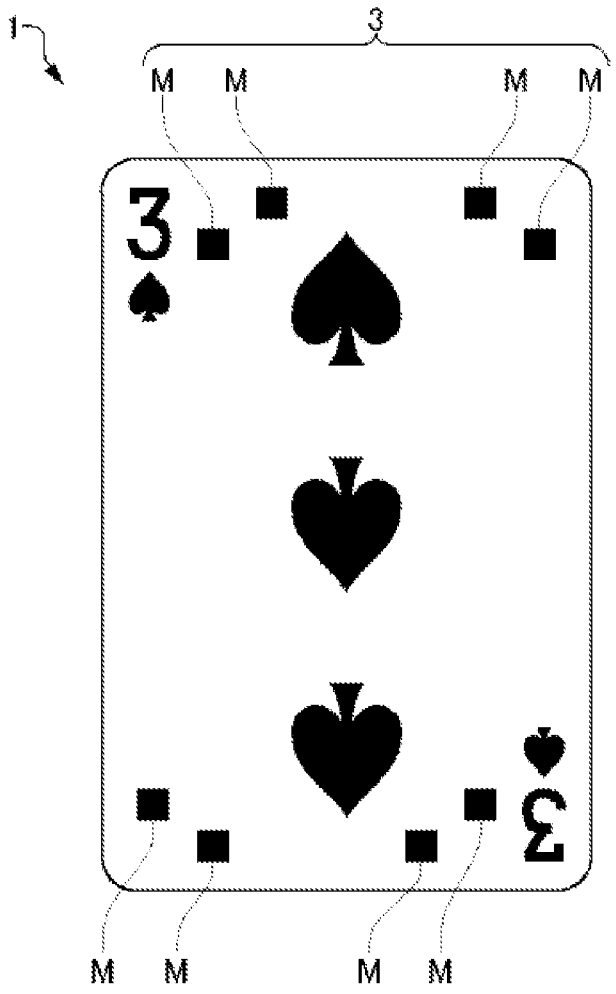
FIG. 3 is a plan view of a card according to the embodiment of the present invention.

A cut card 1*c* is inserted in the shuffled playing card set is before it is set in the card shoe apparatus 2. The cut card 1*c* is inserted at any place within the latter half portion of the shuffled playing card set is when used in a game (in the last quarter or one-fifth of the shuffled playing card set 1*s*). The cut card 1*c* is used to end a game at the game table leaving about 20 to 40 cards 1 in the card shoe apparatus 2, so as to prevent any player from counting the ranks of the cards 1 dealt during a game to predict the ranks of the cards when the number of the cards that have not been dealt yet becomes small. FIG. 3 shows the cards 1 which form the shuffled playing cards. A figure is encoded and printed in UV ink or the like, which is invisible under normal conditions, on each card 1 that is used in table games such as baccarat. In FIG. 3, codes 3, each of which is configured with marks M, are provided in the upper and lower sides of the card 1 in a point-symmetric manner.

Figure 4:
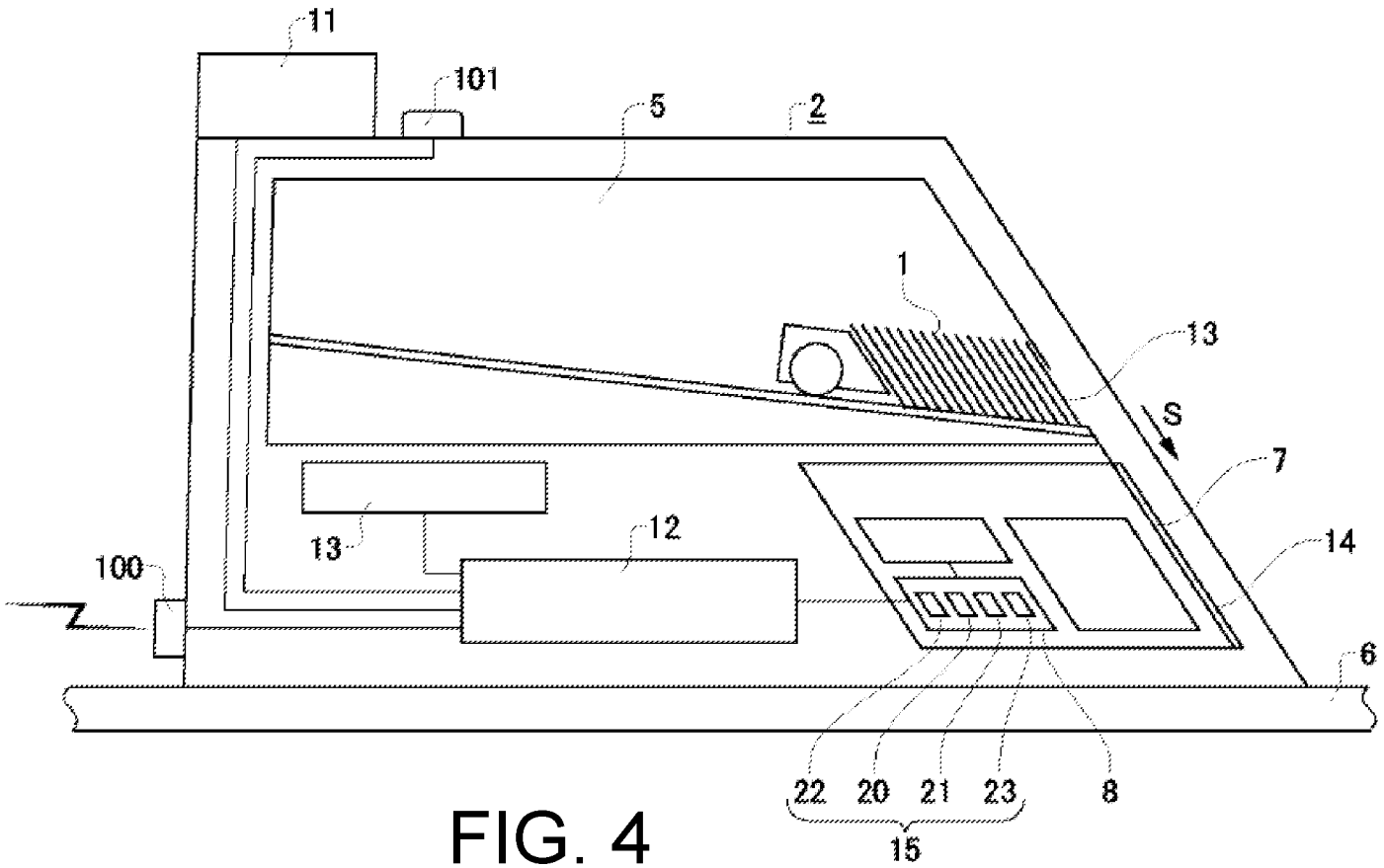
FIG. 4 is a diagram showing a general configuration of the card shoe apparatus.

In FIG. 4, the card shoe apparatus 2 of the table game system of the present embodiment includes a card guide unit 7 that guides the cards 1 that are drawn one by one out of a card housing unit 5 onto a game table 6, and a card reading unit 8 that reads from a card 1, when the card 1 is drawn from the card housing unit 5, the code 3 that indicates the figure (number, rank) of that card 1. The card shoe apparatus 2 further includes a control unit 12 that stores the rules of a card game for determining the winner/loser of the card game (in this example, the baccarat game), and determines the winner/loser based on the numbers (ranks) of the cards 1 read by the card reading unit 8. The control unit 12 stores the rules of a card game in a memory 13 to be described below, and determines the winner/loser between the player and the banker based on the total of the numbers (ranks) of their hands, each hand consisting of several cards 1 that were dealt. An output means 11 (configured from a plurality of lamps) displays the result of this determination.

The control unit 12 includes the memory 13 that stores the information of a predetermined number of cards 1 read by the card reading unit 8, with which the control unit 12 stores the arrangement order of the cards of the shuffled playing cards 1*s*, and has a function of detecting any irregularity described below. Upon the detection of an irregularity in the arrangement order of the cards of the shuffled playing cards is housed in the card housing unit 5, the management division or the pit of the casino is notified thereof by an arrangement order irregularity alarm through an external output means 100. In addition, arrangement order irregularity lamps 101 and a liquid crystal display unit 102 exhibit the irregularity in the cards 1, thereby informing a dealer or the like thereof. A wired or wireless communication means is used as a means of outputting the irregularity alarm.

Note that the irregularity alarm is given by a two-phase alarm system. In the first phase, an alarm is displayed in the liquid crystal display unit 102, which is a side display of the card shoe apparatus 2, upon the detection of an irregularity such that only the dealer who has the role of dealing the cards can know the irregularity. Next, in the second phase, the irregularity alarm is given as a final irregularity display at the end of the game during which the irregularity occurs. In this case, an arrangement order irregularity alarm is given to the management division or the pit of the casino through the external output means 100, and in addition, the arrangement order irregularity lamp(s) 101 is(are) lighted to indicate the irregularity in the arrangement order of the cards 1.

Figure 5A:
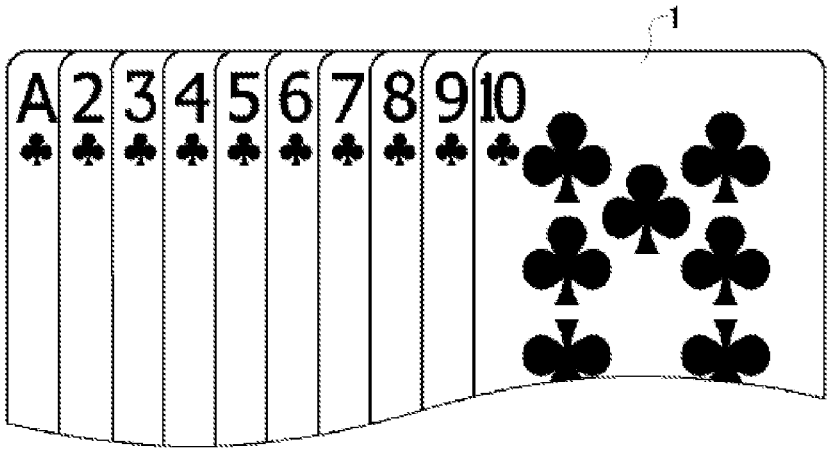
FIG. 5A is a plan view showing an example of an irregularity in the arrangement order of cards detected by the card shoe apparatus.
Figure 5B:
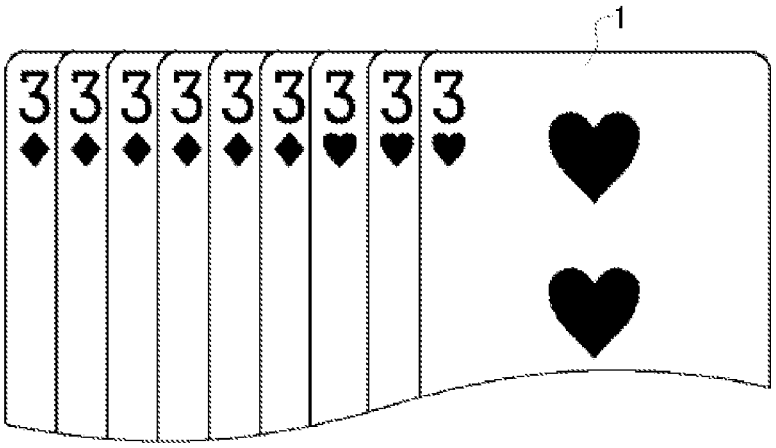
FIG. 5B is a plan view showing another example of an irregularity in the arrangement order of cards.

Next, an irregularity in the arrangement order of the cards will be described. FIG. 5A and FIG. 5B each show a typical example of an irregularity in the arrangement order of the cards. FIG. 5A shows an example where the cards 1 drawn from the card housing unit 5 have the same suit (Clubs) with sequential figures (number, rank) beginning from Ace. FIG. 5B shows an example where the cards 1 drawn from the card housing unit 5 consist of 9 cards with the same rank (3). Generally, the cards of the shuffled playing cards is are shuffled by a random number generator or the like so as to be arranged in a random order. The arrangement order as shown in FIGS. 5A and 5B indicates an irregular shuffling of the shuffled playing card set 1*s*, which is thus determined to be irregular. Including the examples described above, possible examples of an irregularity in the arrangement order are listed below:

(1) a case where a state in which the rank of a card is larger (or smaller) by one than the card preceding that card continues for a predetermined number of cards (for example, 1, 2, 3, 4, - - - , K) (as shown in FIG. 5A);

(2) a case where cards with the same rank continue for a predetermined number of cards (for example, A, A, A, A, - - - ) (as shown in FIG. 5B);

(3) a case where the same sequence is repeated throughout a predetermined number of cards (for example, A, Q, 10, A, Q, 10, - - - );

(4) a case where cards with the same suit continue for at least a predetermined number of cards (for example, 13 consecutive cards with Hearts); and (5) a case where the arrangement order of a predetermined number of cards matches an arrangement order registered in advance (this is a case where the arrangement order used in a separate card manufacturing process appears, which case can also be considered irregular (shuffling failure)).

These irregular patterns are stored in the memory 13 in advance, and the control unit 12 compares the information of the cards 1 read by the card reading unit 8 with such patterns. If the arrangement order of a predetermined number of cards 1 matches any of these irregular patterns, it is determined to be irregular.

A sample case of an irregularity in the arrangement order of the shuffled playing cards described in (e) above, where the arrangement order of a predetermined number of cards matches an arrangement order that has been registered in advance, is a case where the state in which the suit and rank of a card drawn are the same as those of the card preceding it by 52 cards continues for a plurality of cards. This is to enable the detection of an irregular case where a shuffling of a plurality of decks has failed for some reason, and instead each of the 52 cards is arranged in the same arrangement order. Note that as another example of an irregularity in the arrangement order, the arrangement order of the cards used when manufacturing the cards, and which is unique to the card manufacturing process may be defined as an irregular case, and stored in advance.

Further, as a example of an irregularity in the arrangement order of the shuffled playing cards, (7) a case that corresponds to a case that has been registered in advance as an irregular case and (8) a case where cards with the same rank and suit are drawn for at least a predetermined number of cards, can be considered. Regarding (7) a case that corresponds to a case that has been registered in advance as an irregular case, for example, the same arrangement order as the that of the rank and suit of each card (plurality of the cards) previously read by the card shoe apparatus 2 continue for a predetermined number of cards or a predetermined number of games in the set of cards currently read by the card shoe apparatus 2. Regarding (8) a case where cards with the same rank and suit are drawn for at least a predetermined number of cards, for example, the shuffled playing cards is housed in the card housing unit 5 are consist of the predetermined number of decks of cards (usually 6, 8, 9 or 10 decks), and the cards the number of which is more than that number of decks (the 9.sup.th card of the same mark is drawn in the 8 decks of the shuffled playing cards) are not supposed to be housed in the card housing unit 5, and if the cards the number of which is more than that number of decks are drawn, that means existence of irregularity.

In this case, the card shoe apparatus 2 stores at least several sets ("8 decks" times "several sets") of the sequence of the suit and the rank in a result of reading cards previously.

According to such a embodiment, the case where the cards which were previously used are not disposed and illegally reused (where the sequence of the cards which were previously read re-appears) can be found as shuffle-irregular.

An irregularity in the arrangement order of the shuffled playing cards refers to a case where an irregular state continues throughout a predetermined number of cards. It is further preferable that a preliminary alarm of irregularity is given, as a stage prior to the occurrence of an irregularity in the arrangement order, during the card that is several cards before the end of a predetermined number of cards. The preliminary alarm is given in a form different from the final alarm, for example, by characters, in a certain color, or with a different lamp. Also, since it is a preliminary alarm, if a state does not continue to be irregular throughout a predetermined number of cards and returns to a random state, then the preliminary alarm is cancelled.

Figure 6:
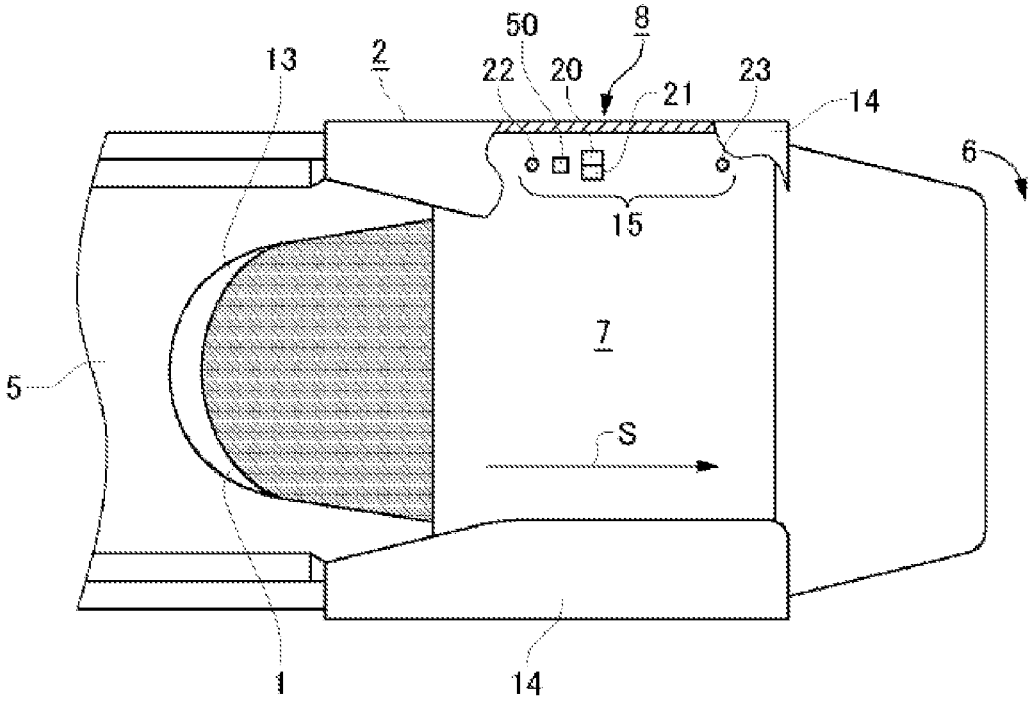
FIG. 6 is a plan view of a card guide of the card shoe apparatus in which main portions are enlarged and the card guide is partially broken.

Next, the card reading unit 8 that reads the code 3 from a card 1 will be described in detail with reference to FIG. 6. FIG. 6 is a plan view in which main portions of the card shoe apparatus 2 are enlarged. In FIG. 6, some portions are enlarged for the purpose of description, and thus FIG. 6 does not necessarily accurately reflect the relative scale. The card reading unit 8 is provided in the card guide unit 7 that guides the cards 1 drawn one by one from the opening 13 of the card housing unit 5 onto the game table 6, with the opening 13 provided in a front portion of the card housing unit 5. The card guide unit 7 is an inclined surface, and a card guide 14 is attached to a portion of the edge of each of both sides thereof, with the card guide 14 also serving as a sensor cover. Also, each of the two card guides 14 is configured to be attachable/detachable with screws or the like (not shown). When a card guide 14 is removed, a sensor group 15 of the card reading portion 8 is exposed. The sensor group 15 is composed of four sensors, including two ultraviolet reactive sensors (UV sensors) 20 and 21, and object detection sensors 22 and 23.

The object detection sensors 22 and 23 are optical fiber sensors that each detect the presence of a card 1. The object detection sensor 22 is placed in the upstream side of the card guide unit 7 relative to the travel direction of the card 1, and the object detection sensor 23 is placed in the downstream side of the card guide unit 7 relative to the travel direction of the card 1. As shown in FIG. 6, the object detection sensors 22 and 23 are provided in the upstream and downstream sides of the UV sensors 20 and 21, respectively. Each of the UV sensors 20 and 21 includes an LED (UV LED) that emits an ultraviolet ray and a detector. The marks M are printed on the card 1 in UV luminescent ink that emits color when UV ray is applied. The card 1 is irradiated with the UV ray (black light), and the detector detects the light reflected by the marks M of the code 3 of the card 1. The UV sensors 20 and 21 are connected to the control unit 12 of the card reading unit 8 via a cable. In the card reading unit 8, the arrangement patterns of the marks M are determined based on the output signals of the detectors of the UV sensors 20 and 21, and the number (rank) corresponding to the code 3 is determined.

In the card reading unit 8, the start and end of the reading performed by the UV sensors 20 and 21 are controlled by the control unit 12 based on the detection signals from the object detection sensors 22 and 23. Also, the control unit 12 determines whether the card 1 has normally passed through the card guide unit 7 based on the detection signals from the object detection sensors 22 and 23. As shown in FIG. 3, the rectangular marks M are arranged within a framework of two rows with four columns on each of the upper and bottom edges of the card 1, and the arrangement of such marks M indicates the rank (number) and the suit (Heart, Spade or the like) of the card 1. If the UV sensor(s) 20 and/or 21 detect(s) a mark M, such UV sensor(s) give(s) out an on signal. The card reading unit 8 determines the relative relation between the signals received from the two UV sensors 20 and 21. By this way, the card reading unit 8 identifies the code based on the relative difference or the like between the two marks M detected by the two UV sensors 20 and 21, thereby identifying the number (rank) and the type (suit) of the corresponding card 1.

The relation between the code 3 and the output of the on signals of the two UV sensors 20 and 21 are shown in FIG. 7. It is possible to identify a predetermined arrangement pattern of the marks M based on the comparison results of the relative changes in the output of the on signals of the UV sensors 20 and 21. As a result, in two rows (the upper and lower rows), four types of arrangement patterns of the mark M are possible, and since patterns are printed in four columns, it is possible to form 256 types of codes (4×4×4×4). Fifty two (52) different playing cards are each assigned to one of the 256 codes, and the relations of such assignment are stored in a memory or by a program as an association table. A configuration is thereby adopted in which the card reading unit 8 can, by identifying the code 3, identify the number (rank) and the type (suit) of the card 1 based on that predetermined association table (not shown). Also, 52 cards can be freely associated with 52 codes out of the 256 codes to be stored in the association table, and thus, there will be a variety of associations between them. Therefore, it is possible to change the associations between the 256 codes and the 52 cards depending on the time or place. Preferably, the code is printed with a paint material that becomes visible when irradiated with a UV ray, and placed in a position where it does not overlap the indications of the card types or indexes 102.

Next, the configuration of the control unit 12 will be described in further detail. The control unit 12 and the like are achieved by a computer apparatus. For example, the process function of automatically determining the winner/loser of a game (in the control unit 12) is achieved by installing in a computer a program for determining the winner/loser, and that program is executed by a processor of the computer. The numbers of the cards sequentially taken out onto the game table 6 are acquired using the UV sensors 20 and 21 in the card reading unit 8, and the numbers of the cards thus acquired are stored sequentially in the memory 13. At this point, information on which card 1 is dealt in what order to which player is also stored. The dealing order of the number and suit of the cards are stored. Although the cards of the shuffled playing card set is have generally been shuffled in advance by a random number generator or the like so as to be arranged in random, if any of the irregular patterns described above appears, it indicates the possibility of an irregular shuffling of the shuffled playing card set 1*s*. The arrangement orders of the cards that should be determined as irregular patterns are stored in the memory 13 in advance or programmed such that the control unit 12 compares the information on the actual arrangement order of the cards 1 that were read by the card reading unit 8 and dealt with the irregular patterns, and if a predetermined number of the cards 1 are drawn in any irregular pattern, it is determined to be irregular.

Figure 8:
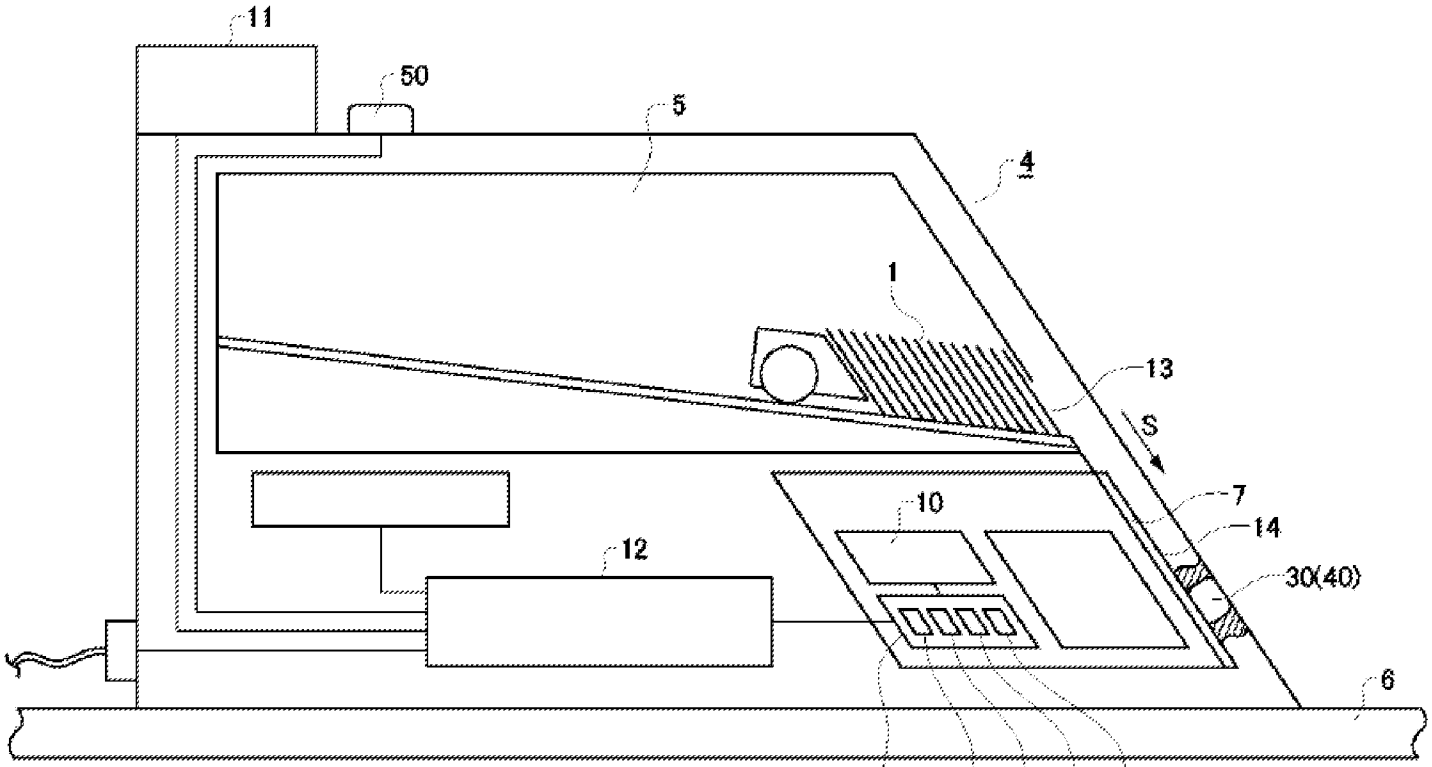
FIG. 8 is a diagram showing a general configuration of the card shoe apparatus.
Figure 9A:
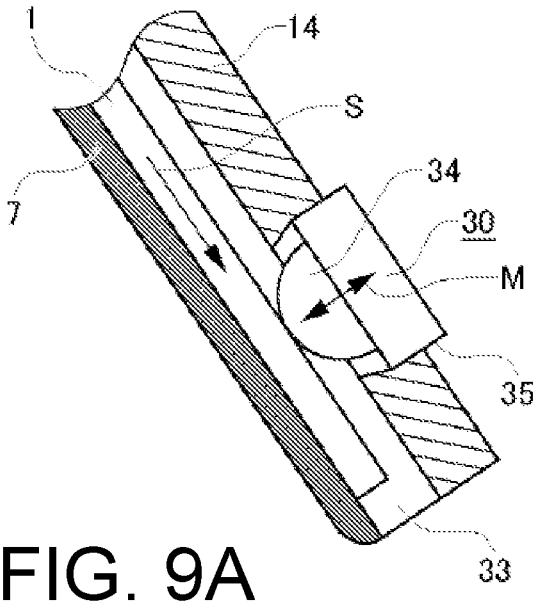
FIG. 9A is a diagram showing an embodiment of the card movement restriction means.
Figure 9B:
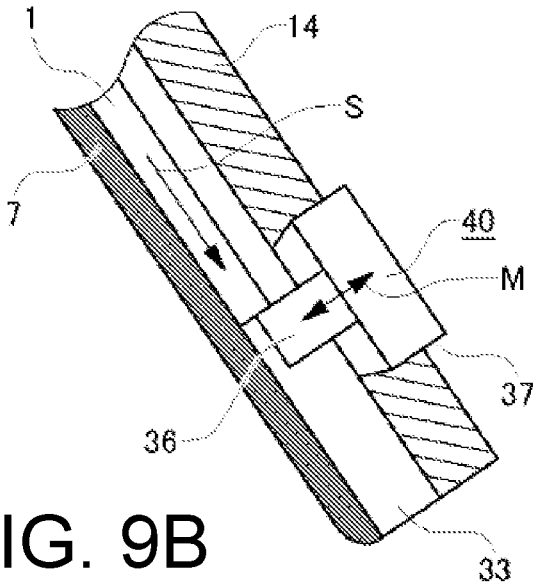
FIG. 9B is a diagram showing another embodiment of the card movement restriction means.

As shown in FIGS. 8, 9A, and 9B, the card shoe apparatus 2 comprises the card movement restriction means 30 that restricts the movement of the card 1 to/from the card housing unit 5. In FIG. 9A, the card movement restriction means 30 is provided in the card guide 14 of the card guide unit 7 that guides the cards 1 taken out one by one from the opening 3, which is provided in a front portion of the card housing unit 5. The card movement restriction means 30 has a structure by which when a card 1 passes through a slot 33 between the card guide unit 7 and the card guide 14, a lock member 34 presses the card 1 to prohibit the movement of the card 1 within the slot 33. The lock member 34 is capable of moving in the direction indicated by the arrow M by a driving unit 35 composed of an electromagnetic solenoid, a piezoelectric device or the like, such that it can take two positions, namely, a position where the card 1 is pressed (restricted position) and a position where the card 1 is allowed to pass through. The driving unit 35 is controlled by the control apparatus 12, and causes the lock member 34 to move to two positions, namely, a position where the card 1 is pressed and a position where the card 1 is allowed to pass through. The rules of the baccarat game are programmed and stored in advance in the control apparatus 12.

Next, an alternative embodiment of the card movement restriction means 30 will be described with reference to FIG. 9B. According to this embodiment, a card movement restriction means 40 has a structure by which when a card 1 passes through the slot 33 between the card guide unit 7 and the card guide 14, a lock member 36 protrudes into the slot 33 to prohibit movement of the card 1. The lock member 36 is capable of moving in the direction indicated by the arrow M by a driving unit 37 composed of an electromagnetic solenoid, a piezoelectric device or the like, such that it can take two positions, namely, a position where movement of the card 1 is prohibited (restricted position) and a position where the card 1 is allowed to pass through. The driving unit 37 is controlled by the control apparatus 12, and causes the lock member 36 to move to two positions, namely, a position where movement of the card 1 is prohibited and a position where the card 1 is allowed to pass through.

The card movement restriction means 30 (40) is caused to function as a result of the driving unit 35 or 37 being controlled by the control apparatus 12 to prevent the fraudulent movement of the card 1. The card movement restriction means 30 (40) is provided with the object detection sensors 22 and 23 as sensors for detecting movement of the card 1, and has a function of detecting movement of the card 1 with these sensors 22 and 23 to restrict the movement of a card. The contents of control object as the fraudulent entry/exit of the card (programmed contents) includes at least the following 1) and 2).

An error signal output unit 50, which, upon the operation of the card entry/exit restriction unit 30 (40), gives an external signal regarding such operation (a lamp is illuminated and an alarm sound is emitted), is provided, and the operation of which is controlled by the control apparatus 12.

As a practical use of the above embodiment, it is applied to controlling the end of the game in the reading apparatus of the shuffled playing cards on the game table. As already explained, the cut card 1*c* is inserted in the shuffled playing card set is before it is set in the card shoe apparatus 2. The cut card 1*c* may be inserted in a predetermined position of at the side or the like of the shuffled playing cards set is at the manufacturing of the shuffled playing cards set is in a factory or may be prepared separately, in any case, the cut card 1*c* is inserted within the latter half portion of the shuffled playing card set is when used in a game (in the last quarter or one-fifth of the shuffled playing card set is). The cut card 1*c* is used to end a game at the game table leaving about 20 to 40 cards 1 in the card shoe apparatus 2 to prevent any player and the like counting the ranks of the cards 1 dealt during a game to predict the ranks of the cards when the number of cards not yet dealt becomes small. Therefore, when the cut card 1*c* is drawn onto the game table, use of the shuffled playing card set is currently in the card housing unit is stopped soon, or after that game or a few games thereafter.

To implement this rule, the control unit 12 further has a cut card checking function of reading the cut card 1*c* by the card reading unit 8 and memorizing the information that indicates the cut card 1*c* is read in the memory 13 when the cut card is drawn onto the game table. When the cut card 1*c* is drawn to the game table, use of the shuffled playing card set 1 *s* currently in the card housing is stopped soon, or after that game or a few games thereafter. The card entry/exit restriction unit 30 (40) is caused to function as a result of the driving unit 35 or 37 being controlled by the program of the control apparatus 12 to prevent the further drawing of the card 1 for stopping further use of the shuffled playing card set 1*s*. The end of the use of the shuffled playing card set is in the card housing 5 has determined, then the end of the use of the cards is reported to an administration section of the casino or pit via the outside output means 100. Furthermore the control unit 12 is configured to have a function of informing the dealer or the like about the end by the display made by lamps or a liquid crystal display unit 102 separately. The cut card 1*c* is normally colored in the black or the like in order to distinguish the other cards, and become recognizable. In addition, the code which is configured to be identified that it is the cut card itself is printed in UV ink or the like which is invisible under normal conditions. The code attached to the cut card 1*c* which is drawn onto the game table is read by the card reading unit 8 in the same way as the above embodiment.

Although the suitable embodiment of the present invention that can be considered at present has been explained hereinbefore, it is to be understood that various modifications can be made to the embodiment, and it is intended that accompanying claims include such all the modifications within the true spirit and the scope of the present invention.

The invention claimed is:

1. A shuffle check system for shuffled playing cards, the shuffle check system comprising:

a card reader configured to read rank or suit information from a card of the shuffled playing cards; and a computer including a memory, the computer configured to detect whether there is a special arrangement of the shuffle playing cards based on rank or suit information of one or more cards of the shuffled playing cards read by the card reader, wherein the special arrangement of the shuffled playing cards includes:

a case where the rank goes up or down one by one in order for a first predetermined number of cards, a case where the same rank continues at a second predetermined number of cards, a case where the same suit continues at a third predetermined number of cards, or a case where the shuffled playing cards repeat the same sequence at a fourth predetermined number of cards.

2. The shuffle check system according to claim 1, wherein an alarm is output when the special arrangement of the shuffled playing cards occur consecutively within the shuffled playing cards.

3. The shuffle check system according to claim 2, wherein a wired or wireless communication means is used as a means to output the alarm.

4. The shuffle check system according to claim 1, wherein the special arrangement is the case where the rank goes up or down one by one in order for the first predetermined number of cards.

5. The shuffle check system according to claim 4, wherein the first predetermined number of cards is a number of consecutive cards of the shuffled playing cards.

6. The shuffle check system according to claim 1, wherein the special arrangement is the case where the same rank continues at the second predetermined number of cards.

7. The shuffle check system according to claim 6, wherein the second predetermined number of cards is a number of consecutive cards of the shuffled playing cards.

8. The shuffle check system according to claim 1, wherein the special arrangement is the case where the same suit continues at the third predetermined number of cards.

9. The shuffle check system according to claim 8, wherein the third predetermined number of cards is a number of consecutive cards of the shuffled playing cards.

10. The shuffle check system according to claim 1, wherein the special arrangement is the case where the cards repeat the same sequence at the fourth predetermined number of cards.

11. The shuffle check system according to claim 10, wherein the fourth predetermined number of cards is a number of consecutive cards of the shuffled playing cards.

12. The shuffle check system according to claim 1, further comprising an alarm output means configured to output an alarm signal based on detection of the special arrangement by the computer.

13. The shuffle check system according to claim 1, further comprising a card shoe, wherein the card shoe includes the card reader and the computer.

14. A method comprising:

reading, at a card reader of a shuffle check system, rank or suit information from a card of shuffled playing cards; and detecting, by a computer of the shuffle check system including a memory, whether there is a special arrangement of the shuffle playing cards based on rank or suit information of one or more cards of the shuffled playing cards read by the card reader, the computer including a memory, and wherein the special arrangement of the shuffled playing cards includes:

a case where the rank goes up or down one by one in order for a first predetermined number of cards, a case where the same rank continues at a second predetermined number of cards, a case where the same suit continues at a third predetermined number of cards, or a case where the shuffled playing cards repeat the same sequence at a fourth predetermined number of cards.

15. The method according to claim 14, further comprising outputting an alarm signal based on detection of the special arrangement by the computer.

16. The method according to claim 14, wherein the special arrangement is the case where the rank goes up or down one by one in order for the first predetermined number of cards, and wherein the first predetermined number of cards is a number of consecutive cards of the shuffled playing cards.

17. The method according to claim 14, wherein the special arrangement is the case where the same rank continues at the second predetermined number of cards, and wherein the second predetermined number of cards is a number of consecutive cards of the shuffled playing cards.

18. The method according to claim 14, wherein the special arrangement is the case where the same suit continues at the third predetermined number of cards, and wherein the third predetermined number of cards is a number of consecutive cards of the shuffled playing cards.

19. The method according to claim 14, wherein the special arrangement is the case where the cards repeat the same sequence at the fourth predetermined number of cards, and wherein the fourth predetermined number of cards is a number of consecutive cards of the shuffled playing cards.

20. The method according to claim 14, wherein the shuffle check system includes a card shoe, wherein the card shoe includes the card reader and the computer.

* * * * *